US006347926B1

(12) United States Patent
Pyrhönen

(10) Patent No.: US 6,347,926 B1
(45) Date of Patent: Feb. 19, 2002

(54) DRIVE APPARATUS, SUCH AS A LIQUID RING MACHINE AND A METHOD FOR DRIVING A DRIVE APPARATUS, SUCH AS TRANSFERRING FLUID

(75) Inventor: Juha Pyrhönen, Lappeenranta (FI)

(73) Assignee: Rotatek Finland Oy, Lappeenranta (FI)

( * ) Notice: Subject to any disclaimer, the term of this patent is extended or adjusted under 35 U.S.C. 154(b) by 0 days.

(21) Appl. No.: 09/147,639

(22) PCT Filed: Aug. 5, 1997

(86) PCT No.: PCT/FI97/00464

§ 371 Date: Mar. 30, 1999

§ 102(e) Date: Mar. 30, 1999

(87) PCT Pub. No.: WO98/05866

PCT Pub. Date: Feb. 12, 1998

(30) Foreign Application Priority Data

Aug. 5, 1996 (FI) ..... 963088

(51) Int. Cl.[7] ..... F04C 19/00
(52) U.S. Cl. ..... 417/53; 417/68; 417/356
(58) Field of Search ..... 417/68, 356, 53

(56) References Cited

U.S. PATENT DOCUMENTS 3,143,972 A * 8/1964 Smith ..... 103/87
4,050,851 A * 9/1977 Haavik ..... 417/66
5,088,899 A * 2/1992 Blecker ..... 417/356
5,090,874 A 2/1992 Aikawa et al.
5,295,794 A 3/1994 Haavik
5,653,582 A * 8/1997 Harvey et al. ..... 417/68

FOREIGN PATENT DOCUMENTS

| | | |
|---|---|---|
| DE | 587 533 | 11/1933 |
| DE | 36 41 142 C2 | 6/1988 |
| DE | 43 39 029 A1 | 5/1995 |

* cited by examiner

*Primary Examiner*—Charles G. Freay
*Assistant Examiner*—Ehud Gartenberg
(74) *Attorney, Agent, or Firm*—Arent Fox Kintner Plotkin & Kahn, PLLC

(57) ABSTRACT

An actuator, such as a liquid ring machine, and a method in an actuator, such as transferring of fluid, is such that the machine includes a casing part within which a rotatable blade rotor is arranged. The casing part forms a hollow rotatable rotor, the inner space thereof receiving the blade rotor. A stator is provided around the casing part, whereby the casing part is rotated by an electromagnetic field between the stator and the casing part arranged to form a rotor of an electric machine.

8 Claims, 2 Drawing Sheets

Figure 2B:
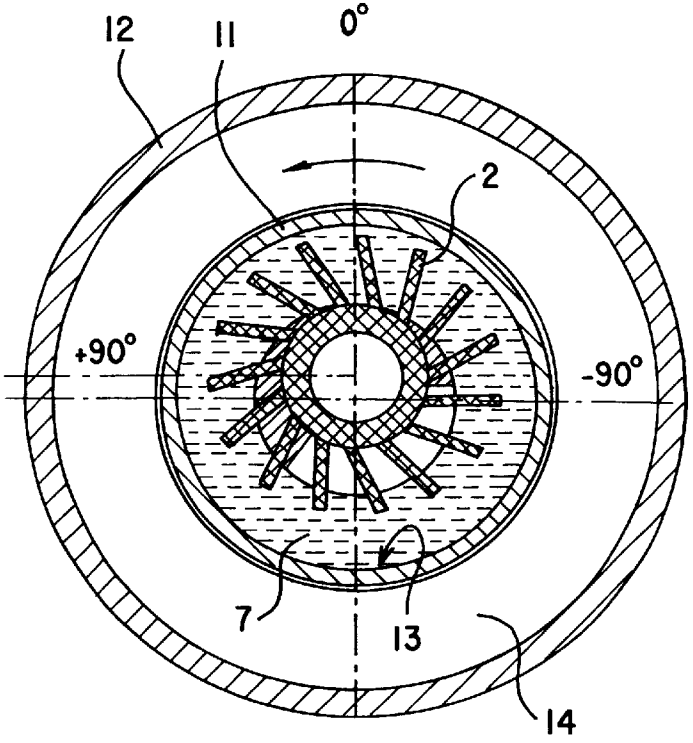

Fig.1a
PRIOR ART
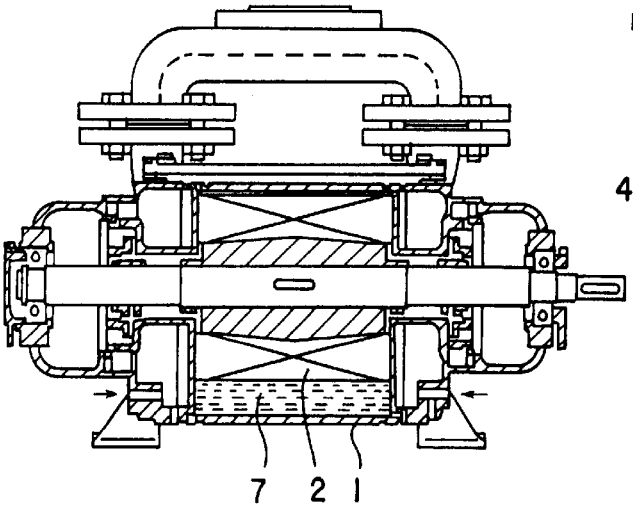
Fig.1b
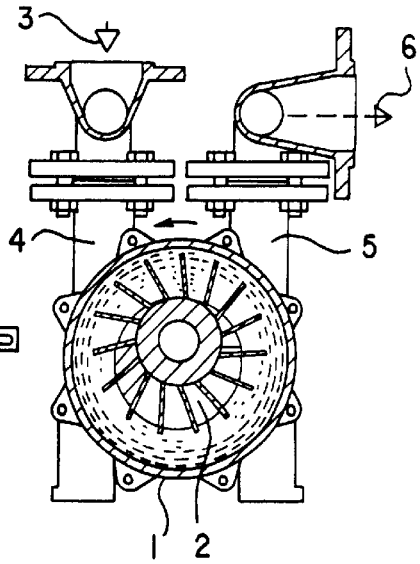
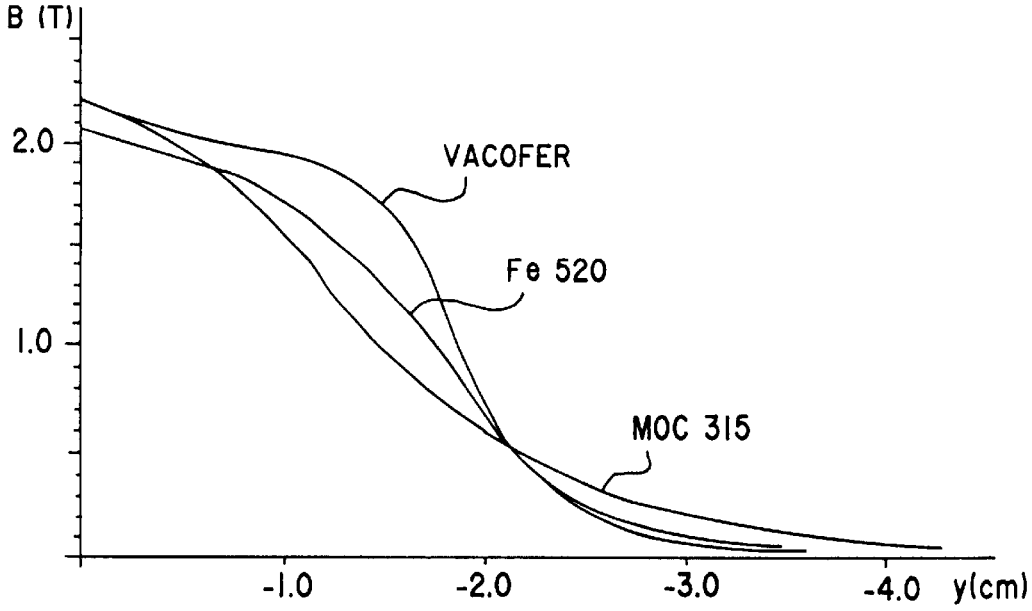
I = 90 A, $U_V$ = 123 V, 400 Hz
MOC 315M , s = 0,0089
Fe 520 , s = 0,0090
VACOFER SI , s = 0,0050
Fig.3

DRIVE APPARATUS, SUCH AS A LIQUID RING MACHINE AND A METHOD FOR DRIVING A DRIVE APPARATUS, SUCH AS TRANSFERRING FLUID

The invention relates to an actuator and to a liquid ring machine for fluid and especially to a liquid ring machine which comprises a rotor means, such as a blade wheel, which is eccentrically rotatable relative to the casing and provides a positive transfer of fluid. The invention relates also to a method for an actuator and especially to a method for positive transfer of fluid The skilled person is aware of various actuators, such as eg. liquid ring pumps, which are commonly used in applications relating to the transfer of fluid or pumping, such as in the processes and apparatus of the chemical industry, papermaking industry or food industry or in the pumping operations of power plants, waste water plants or similar. The known liquid ring pumps usually comprise a stationary casing and a blade wheel or rotor which is eccentrically rotatable thereto. The blade wheel is rotated by an external motor, usually by an electric machine. Annexed FIGS. 1*a* and 1*b* are referred to in view of the prior art.

This about 60 years ago presented liquid ring pump has achieved a great popularity, especially because of the relatively simple construction thereof and the high reliability in use. The disadvantage of the solution has however been the poor efficiency (about 40%) thereof and the poor adjustability. The poor efficiency is mainly a result of the fact that when the blade wheel rotates the liquid ring, about a half of the power of the drive motor is consumed to overcome the friction between the ring and the inner surface (inner periphery) of the casing. In addition, this causes erosion in the casing and an uneven flow and splattering. The friction work causes also a heating of the pump and also a heating of the liquid to be pumped.

It is an object of the present invention to overcome the disadvantages of the prior art and to provide a new solution for an actuator, such as a liquid ring pump, and a method for using an actuator, such as for a positive fluid transfer. The solution according to the invention provides for instance a liquid pump which has an efficiency which is essentially improved relative to the known solutions.

An object of the invention is also to provide a liquid ring pump and a method for transferring fluid, by means of which a better adjustability than in known solution is achieved.

An object of the invention is to provide a solution, by means of which the size of the drive motor of a rotatable actuator, such as a blade wheel means, feed screw etc., can be reduced.

An object of the invention is to provide a solution, by means of which the heating of the machine and the heating of the fluid to be transferred can be reduced.

An object of the invention is a solution which provides an integrated electric machine-gearing actuator.

The invention is based on the idea that the casing part of a liquid ring machine, planetary gear, feed screw structure etc. is arranged to be rotatable. The casing part may preferably be arranged so as to form a hollow rotor means of an electric machine which is rotated in a desired manner relative to the actual, inside the casing provided blade wheel or similar rotatable part. This inventive idea is facilitated by a realization of the fact that in an electric machine the electric flux penetrates only to the surface layer of the rotor, the core part of the rotor having only a small influence to the operation of the machine.

More precisely, the actuator according to the present invention, such as the liquid ring machine, is mainly characterized by what is disclosed in the appended claims.

According to one preferred embodiment the actuator, such as a liquid ring machine, comprises a blade wheel means which is rotated by an external drive device and which is supported on bearings relative to the body of the machine. In addition, the apparatus comprises a rotatable casing means which is eccentrically disposed relative to the blade wheel means. The rotation of the hollow casing means is provided by an arrangement according to which the shell thereof acts as a rotor. Stator means surrounding the rotor are attached to the body of the machine. In this context a reference is made to DE 36 41 142 C2 patent publication, which in FIGS. 1 and 2 thereof discloses one example of a hollow rotor.

It is possible to provide the rotor means with various means effecting the operation thereof, such as by short circuit rings of copper or aluminium or by so called squirrel cage or coiling. Correspondingly, the stator means may eg. comprise so called formed stator teeth without departing from the scope of the invention.

The current supply arrangements, seals and bearings of the different rotating shafts can be implemented in a per se known manner, for instance the bearings can be ball or slide bearings and the seals can be box seals, and they are thus not explained on more detail.

Said rotor provided from the casing can be rotated in a same speed with the blade wheel, but the speed may also be different. The rotational speeds of these two may also be separately adjusted, whereby the difference in speeds therebetween is adjustable. This enables a good adjustability of the machine, since the number of different speeds and/or differences in speed variations becomes essentially high.

Remarkable advantages are obtained by the invention. For example, the efficiency coefficient of a liquid ring machine is remarkably improved due to an essentially remarkable decrease in the influences of friction. The rise in the temperature caused by the friction work is essentially decreased. In addition, the power requirement is decreased, and thus it is possible to use a smaller drive device for the rotation of the blade wheel, which has an essential influence in view of the purchasing and operation costs of the device. The decrease in the power requirement is estimated to be about 50%. The outer diameters of the liquid ring machine are still moderate, when considering the advantage obtained. In addition, the erosion of the inner periphery of the casing and splattering decrease essentially, or are even entirely removed. By means of the invention it is possible to provide an essentially compact structure, such as an actuator containing an electric machine and a gearing device.

In the following the present invention and the other objects and advantages thereof will be described in exemplifying manner with reference to the annexed drawings, in which similar reference characters throughout the various figures refer to similar features. It should be understood that the following exemplifying description of the invention is not meant to restrict the invention to the specific forms presented in this connection but rather the present invention is meant to cover all modifications, similarities and alternatives which are included in the spirit and scope of the present invention, as defined by the appended claims. It is also noted that the term liquid ring pump used in the exemplifying embodiment is intented to means all such liquid ring machines operating in the above explained basic principle and used for a positive transfer of fluids, such as different liquids, gases etc.

FIGS. 1*a* and 1*b* disclose a prior art liquid ring pump from the side and end thereof.

Figure 2A:
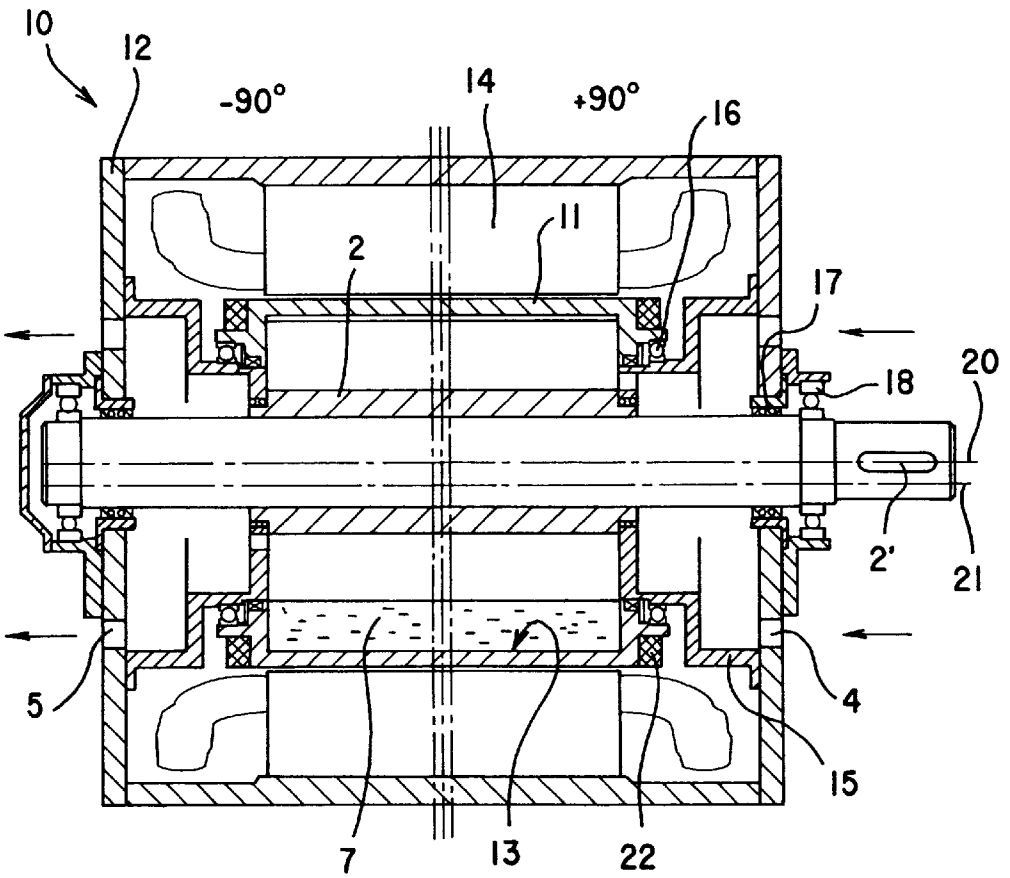

FIGS. 2*a* and 2*b* disclose one embodiment of the liquid ring machine according to the present invention.

FIG. 3 is a line diagram of the penetration of the electric flux to rotors manufactured from different materials.

FIGS. 1*a* and 1*b* disclose sectional views from the side and end of a prior art liquid ring pump comprising a stationary casing 1 and a blade wheel 2 which is eccentrically supported by bearings within the casing. The fluid to be pumped enters along an input channel 4 as indicated by an arrow 3 and is removed through an output channel 5 as is indicated by an arrow 6. The liquid ring which is rotated along the inner periphery of the casing 1 by the blade wheel 2 is designated by 7. The external drive apparatus (not shown) providing the rotation, such as an electric machine, is coupled on the shaft of the blade wheel 2 in a per se known manner.

FIGS. 2*a* and *b* disclose correspondingly the structure of the liquid ring machine according to the invention. A per se known blade wheel means 2 rotated by an external drive apparatus is disposed rotatably by means of bearings 18 on the body 12. A casing part 11 according to the present invention is also assembled rotatably on the body 12 by means of bearings 16. The casing part 11 is surrounded by stator means 14 assembled on the body 12, said stator means being of per se known structure consisting stator plates.

A suction opening or input opening 4 and a removal opening 5 in the pressurized side are also disclosed. In the example of FIG. 2 these are provided by utilizing the supports 15 of the bearings 16 attached to the body 12. The necessary seals, such as 17, may be of per se known type box seals, lip seals etc. means proving the sealing. The example discloses also one solution for positioning the suction opening 4 and the removal opening 5 of the fluid relative to the center axis 21 such that they are disposed about 180° apart from each other within the rotor 11. This is, however, not the only possible solution.

According to one solution the diameter of the blade wheel rotor at the ends of the blades is about 250 mm, the diameter of the inner periphery 13 of the rotor being about 300 mm. The thickness of the rotor shell may be eg. about 15–40 mm. The outer periphery of the body 12 of the machine is in the example about 520 mm.

The liquid ring forming an essential part of the operation of the machine is designated by 7.

The arrangement is preferably such that the casing part 11 supported by bearings centrally relative to the body 12, the axis line 21 presenting the center line of the rotor 11. The blade wheel 2 is supported by bearings eccentrically relative to the body 12 along another center line 20, wherein it is thus eccentrically supported by the bearings relative to the casing part 11 as well. However, it is to be noted that other arrangements are also possible and that what is essential here is that both the casing part 11 arranged to form a rotor and the blade wheel means 2 are rotatable and disposed eccentrically relative to each other.

The figure discloses also an advantageous additional feature according to which the hollow rotor 11 in accordance with the invention is provided with a short circuit ring 22, which may preferably be eg. of copper, of aluminium or similar material having a good electrical conductivity.

The line diagram of FIG. 3 illustrates the phenomenon which enables the invention, ie. the penetration of an electric flux to rotors manufactured from different materials in a nominal point of a motor where I=90A, $U_v$=123 V, 400 Hz. The strength of the flux as the T value is announced by the vertical axis and the depth y of the point which is examined is announced by the horizontal axis in cm value. As can be seen from the figure, the decrease in the strength of the penetration of the flux with different materials is essentially small from the depth of 2 cm and thereafter. After a depth value of 3 cm it can be said that the influence of the flux penetration is of no importance. Thus, the flux penetration does not set any specific bars for the utilization of a hollow rotor having a wall thickness of about 2 cm. Even thinner of thicker wall thickness may be used. However, the thinner wall may in some cases, depending on the material, have a disadvantageous influence to the properties of the motor, such as to the efficiency thereof.

As can be noted from the diagram, there are no significant differences in the penetration of the fluxes of the different materials. However, the VACOVER and Fe 520 steel grades can be kept slightly more preferable than the MOC 315 grade, but even this fulfills those requirements which has been set for the material of the rotor means 11 of the present invention.

The operation of the liquid ring machine 10 in accordance with the invention comprises rotating of the blade wheel rotor 2 by an external drive device in a per se known manner. In addition, the casing part 11 which is arranged to form a hollow rotor of an electric machine is also rotated. The operation of the casing part 11 arranged to operate as a rotor means corresponds the operation of a per se known hollow rotor of an electric machine, and is thus not explained in more detail herein. The rotational speeds of the rotors 2 and 11 may be equal, but it is also possible to arrange a desired difference in the speeds therebetween. The rotor means 2 may also be set to a nonrotational stage or to rotate freely. In case the casing part 11 is not rotated, the machine 10 will operate as a prior art liquid ring pump.

The fluid to be transferred, such as liquid or gas, enters into the casing part 11 through an input channel 4 and is removed due to a rise in the pressure/transfer effect caused by the blade wheel 2 through a removal opening 5 in the pressurized side in a per se known manner. The essential difference to the prior art is that also the inner shell 13 of the casing part 11 is now rotatable, whereby the shaping and construction of the channels 4 and 5, for instance in view of the sealing, differs from the prior art arrangements.

Similar principle, according to which the rotatable casing part may form also the rotor part of an electric machine, cam also be used in several other applications, such as in planetary gears, different feed screws etc., without departing from the basic principles of the invention. What is essential is that according to the invention the actuator member can be disposed within a hollow space, which space can be rotated by stator means provided around the outer surface of the casing part of this actuator. As an example only, it can be mentioned that the size of the integrated assemblies of an electric machine and a gear becomes essentially small while they will have a good adjustability.

Therefore, by means of the invention an apparatus and a method is provided, by which a remarkable improvement has been achieved in the area of the liquid ring machines, especially in view the efficiency and adjustability thereof.

It is to be noted that the above examples of the embodiments of the invention do not limit the scope of the invention which is defined by the claims.

What is claimed is:

1. A liquid ring machine comprising a rotatable casing part, a blade wheel means within the casing part and arranged to be eccentrically rotatable relative to the casing part, and channel means for the inputting and removal of fluid, wherein the casing part is arranged to form a hollow rotatable rotor means of an electric machine, wherein the inner surface thereof defines a space for receiving the liquid ring and the blade wheel means, and stator means provided around the outer periphery of the casing part.

2. An apparatus according to claim 1, wherein said rotor means is supported by bearings centrally relative to the body of the machine and said blade wheel means is supported by bearings eccentrically relative to said body.

3. An apparatus according to claim 1 wherein the channel means comprises bearing supports rotatably supporting the rotatable casing part.

4. A method for transferring fluid, said method comprising steps of leading a liquid into a casing part of a liquid ring machine, rotating a blade wheel means arranged within the casing part and eccentrically relative said casing part for transferring the liquid towards a removal opening of the casing part, and rotating of said casing part, wherein the hollow casing part is rotated by means of an electromagnetic field between stator means provided around the outer periphery of the casing part and the outer periphery of the casing part.

5. An apparatus according to claim 1, wherein the rotor means comprises a short circuit ring of copper or aluminium.

6. A method according to claim 4, wherein the rotor means and the hollow casing part are rotated in an essentially similar speed of rotation.

7. A method according to claim 4, wherein the actuator member or the rotor means and the hollow casing part are rotated in speeds which are different from each other.

8. A method according to claim 4, wherein at least the speed of rotation of the actuator member or the rotor means or the hollow casing part is adjusted during the use thereof.

* * * * *